US008689999B2

(12) United States Patent
Cooper et al.

(10) Patent No.: US 8,689,999 B2
(45) Date of Patent: Apr. 8, 2014

(54) HAIR STYLING DEVICE HOLSTER

(75) Inventors: Kerry Cooper, Pleasantville, NY (US); George Calvin Scott, New Fairfield, CT (US); Joel Beebe, Columbus, OH (US); Christopher Hawker, Columbus, OH (US); Jessica Moreland, Columbus, OH (US); Christopher Trunek, Salt Lake City, UT (US)

(73) Assignee: Polder Housewares, Inc., Oxford, CT (US)

( * ) Notice: Subject to any disclaimer, the term of this patent is extended or adjusted under 35 U.S.C. 154(b) by 124 days.

(21) Appl. No.: 13/346,461

(22) Filed: Jan. 9, 2012

(65) Prior Publication Data

US 2012/0175372 A1 Jul. 12, 2012

Related U.S. Application Data

(60) Provisional application No. 61/431,274, filed on Jan. 10, 2011.

(51) Int. Cl.
*B65D 1/24* (2006.01)

(52) U.S. Cl.
USPC ..... 220/507; 220/23.88; 220/486; 220/495; 206/581; 206/823; 219/242; 211/26; 211/70

(58) Field of Classification Search
USPC ..... 220/23.88, 486, 495, 507; 206/581, 206/823; 211/26, 70.6; 219/242
See application file for complete search history.

(56) References Cited

U.S. PATENT DOCUMENTS

| | | | | |
|---|---|---|---|---|
| D287,203 | S | 12/1986 | Jenkins et al. | |
| 5,577,607 | A * | 11/1996 | Drake et al. | 206/349 |
| 5,917,694 | A | 6/1999 | Denny | |
| 6,769,554 | B1 | 8/2004 | Udofiah | |
| D603,562 | S | 11/2009 | Mills | |
| 7,624,886 | B2 * | 12/2009 | Huang | 220/6 |
| D607,607 | S | 1/2010 | Russell | |
| 2006/0289367 | A1 | 12/2006 | Cossey | |
| 2009/0020676 | A1 * | 1/2009 | Curry | 248/346.11 |

* cited by examiner

*Primary Examiner* — Anthony Stashick
*Assistant Examiner* — Elizabeth Volz
(74) *Attorney, Agent, or Firm* — Duane Morris LLP

(57) ABSTRACT

A hair styling device holster includes a bottom section, a middle section, and a top section. The bottom section includes a flat bottom surface. The middle section is coupled to the bottom section and includes walls that define an interior compartment sized and configured to receive a heated end of a hair styling device. At least a portion of one of the plurality of walls including a mesh grating. The top section is coupled to the middle section and defines at least one opening in communication with the interior compartment defined by the middle section. An insulating material is disposed on an upper interior surface of the bottom section for insulating the bottom section from a hair styling device when the hair styling device is disposed within the first opening.

17 Claims, 7 Drawing Sheets

HAIR STYLING DEVICE HOLSTER

CROSS-REFERENCE TO RELATED APPLICATIONS

This application claims priority to U.S. patent application Ser. No. 61/431,274 filed Jan. 10, 2011, the entirety of which is hereby incorporated by reference.

FIELD OF DISCLOSURE

The disclosed system relates to organizational devices. More particularly, the disclosed system relates to an organizational device for hair styling products including those that are powered by electricity.

BACKGROUND

There exists many types of hair styling products and devices on the market such as blow dryers, hair straighteners, curling irons, bobby pins, and the like. Many people store their hair styling devices in drawers or on counters in an unorganized fashion leading to power cords getting tangled and valuable drawer or counter space being used. In addition to taking up valuable space in a drawer or on a counter, such storage of these hair styling devices often leads to a person burning him or herself on one of the devices that uses heat to style hair (i.e., blow dryer, hair straightener, curling iron, etc.) as they are still hot after use. Consequently, many users of heated devices leave them out on counters or in a remote location until they are cool enough to put in a drawer or other storage location.

SUMMARY

In some embodiments, a hair styling device holster includes a bottom section, a middle section, and a top section. The bottom section includes a flat bottom surface. The middle section is coupled to the bottom section and includes walls that define an interior compartment sized and configured to receive a heated end of a hair styling device. At least a portion of one of the plurality of walls including a mesh grating. The top section is coupled to the middle section and defines at least one opening in communication with the interior compartment defined by the middle section. An insulating material is disposed on an upper interior surface of the bottom section for insulating the bottom section from a hair styling device when the hair styling device is disposed within the first opening.

In some embodiments, a hair styling device holster includes a bottom section, a middle section, and a top section. The bottom section includes a flat bottom surface and an interior upper surface. The middle section is coupled to the bottom section and includes walls defining an interior compartment sized and configured to receive a heated end of a hair styling device. At least a portion of one of the plurality of walls including a mesh grating. The top section is coupled to the middle section and defines a plurality of openings each in communication with the interior compartment defined by the middle section. An insulating material is disposed within the plurality of openings defined by the top section and on the interior upper surface of the bottom section.

In some embodiments, a hair styling device holster includes a bottom section, a middle section coupled to the bottom section, and a top section coupled to the middle section. The bottom section includes a flat bottom surface, an interior upper surface, and an opening in which a drawer is disposed. The middle section includes walls defining an interior compartment sized and configured to receive a heated end of a hair styling device. At least a portion of one of the plurality of walls including a mesh grating. The top section defines at least one opening in communication with the interior compartment defined by the middle section. A handle extends from the top section and defines a slot configured to receive a hook therein for hanging the hair styling device holster. An insulating material is disposed within the at least one opening defined by the top section and on the interior upper surface of the bottom section.

DETAILED DESCRIPTION

An improved apparatus for storing and organizing a plurality of hair styling devices is disclosed. The disclosed apparatus is configured to store and organize heated devices (e.g., curling irons, blow dryers, hair straightening tools, etc.) and may optionally be configured to store and organize non-heated devices (e.g., combs, brushes, clips, bobby pins, hair ties, etc.). The apparatus advantageously may be used as a free-standing device or hung from bars and/or hooks. Additionally, the improved hair styling device holster is designed to facilitate fast cooling of heated hair styling devices while at the same time protecting users from being burned by such devices.

Figure 1:
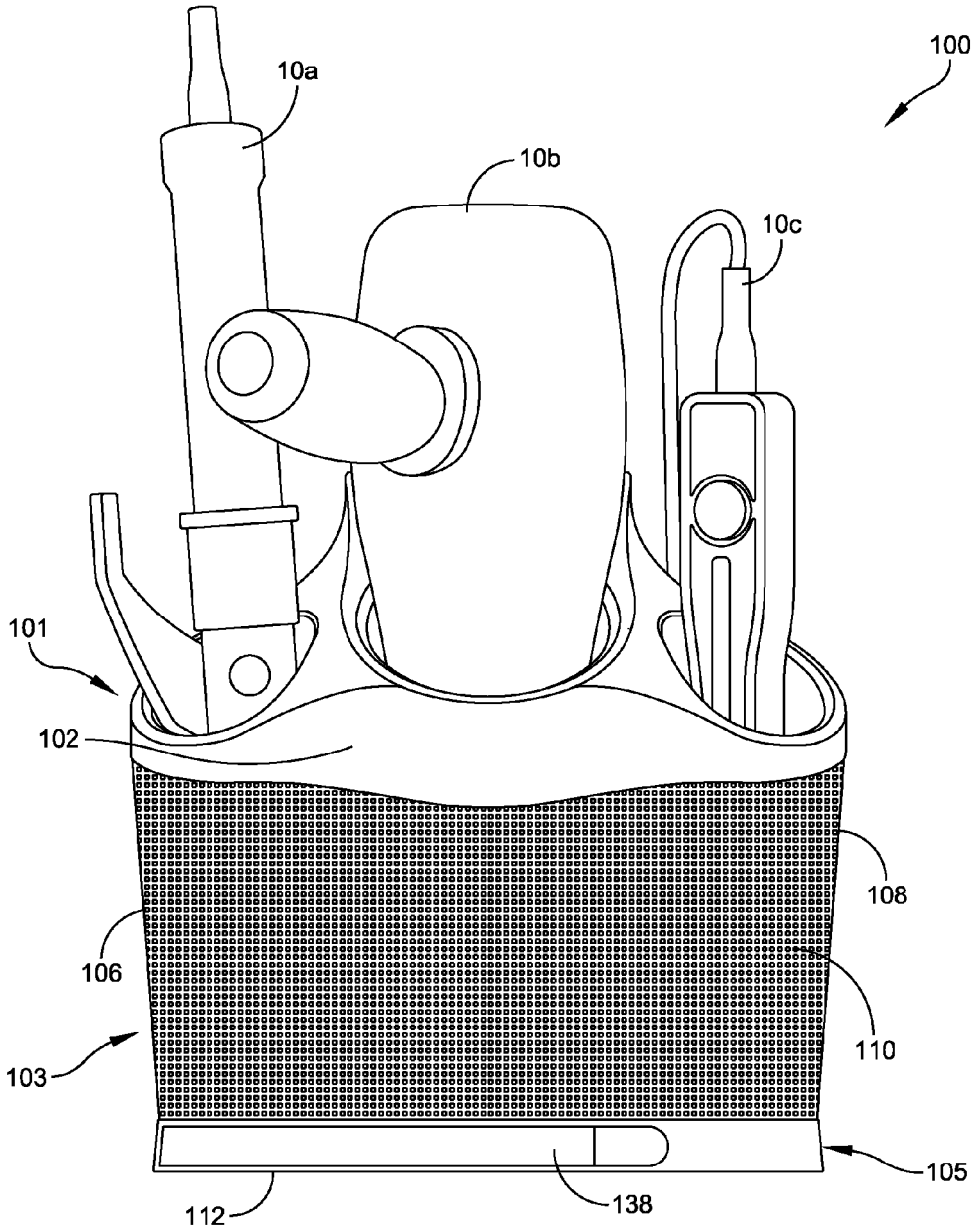
FIG. 1 is a front side view of one example of an apparatus for storing and organizing hair styling equipment.

As shown in the embodiment illustrated in FIG. 1, the hair styling device holster apparatus 100 has a body including a top section 101, a middle section 103, and a bottom section 105. Middle section 103 includes front wall 102 and a rear wall 104 (FIG. 2) that are joined together by opposed side walls 106, 108. Although walls 102, 104, 106, 108 are illustrated as being rounded, one skilled in the art will understand that walls 102, 104, 106, 108 may be planar to form a rectangle or other geometric shape. Walls 102, 104, 106, 108 in combination with upper section 101 and lower section 105 define an interior compartment 107 (FIG. 4) sized and configured to house the heated ends of hair styling devices 10 as described below.

At least a portion 110 of one or more of the front wall 102, rear wall 104, and opposed side walls 106, 108 of middle section 103 includes a mesh grating that enables air to circulate within the interior compartment of holster 100 to aid in the cooling of one or more hair care styling devices 10 supported by apparatus 100. In some embodiments, the mesh portion 110 of walls 102, 104, 106, 108 is fabricated from a metal material, although one skilled in the art will understand that walls 102, 104, 106, 108 of middle section 103 may be formed from a plastic or other material.

Figure 5:
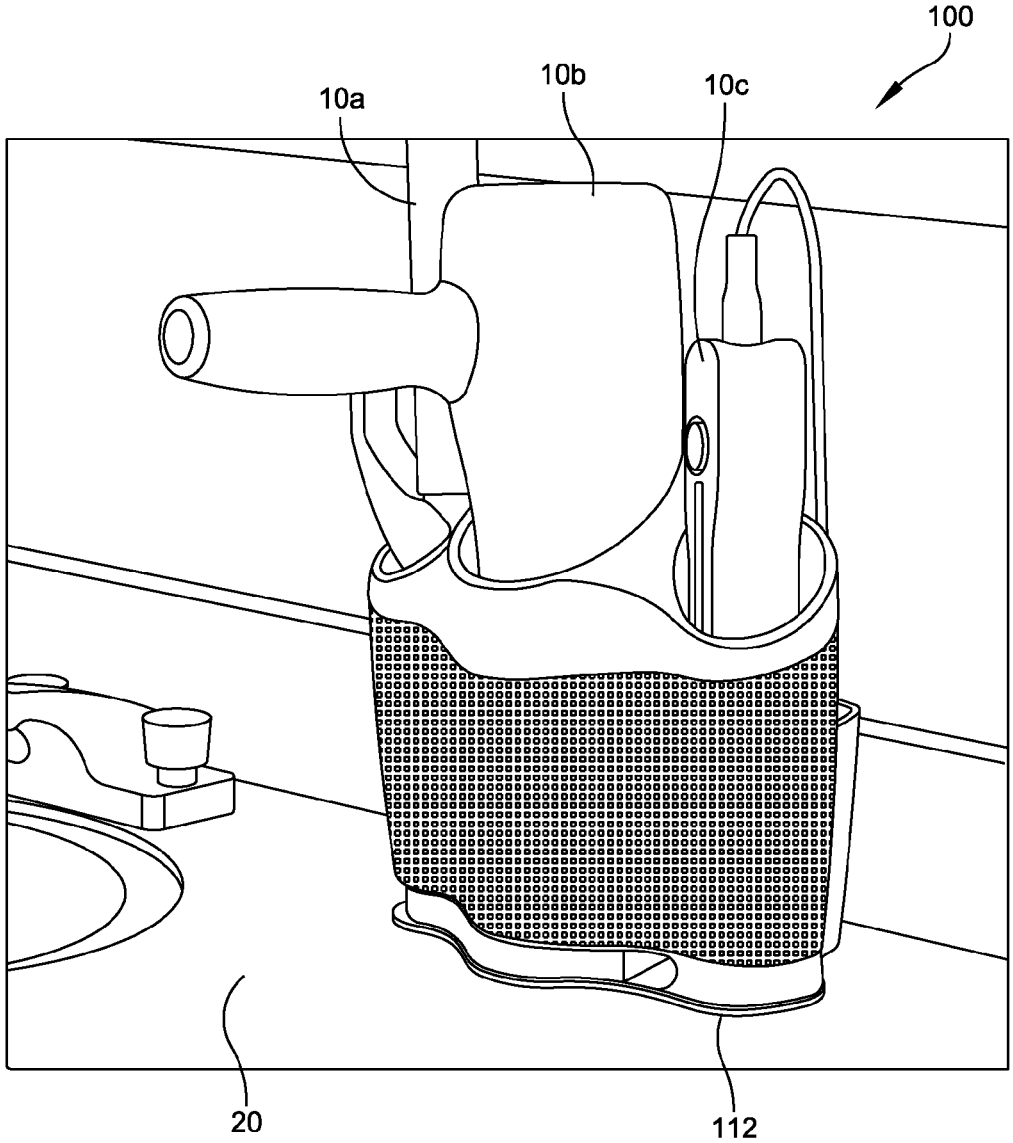
FIG. 5 illustrates an apparatus disposed as a freestanding unit on a counter.

Bottom section 105 includes a bottom wall 112 that may be substantially flat such that bottom wall 112 is configured to support apparatus 100 in an upright position such that apparatus 100 may be a free-standing unit. For example and as illustrated in FIG. 5, bottom wall 112 is supports hair care styling device holster 100 when holster 100 is disposed on a flat surface 20 such as a floor, counter, or the like. Bottom section 105 may be fabricated from a metal or plastic material and integrally formed with or coupled to middle section 103. An insulating material, such as silicone or other material having a high melting point, is disposed on an inner, upper surface of bottom section 105.

Figure 2:
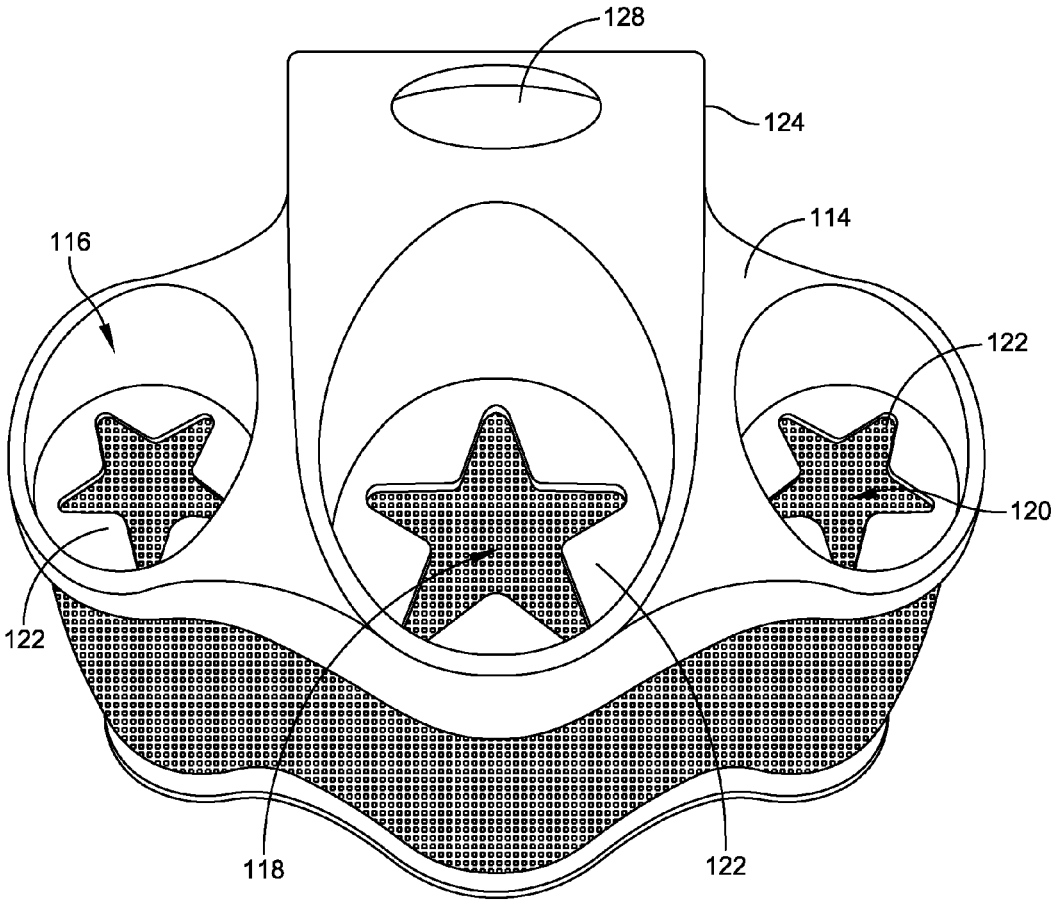
FIG. 2 is a top side plan view of the apparatus illustrated in FIG. 1.
Figure 3:
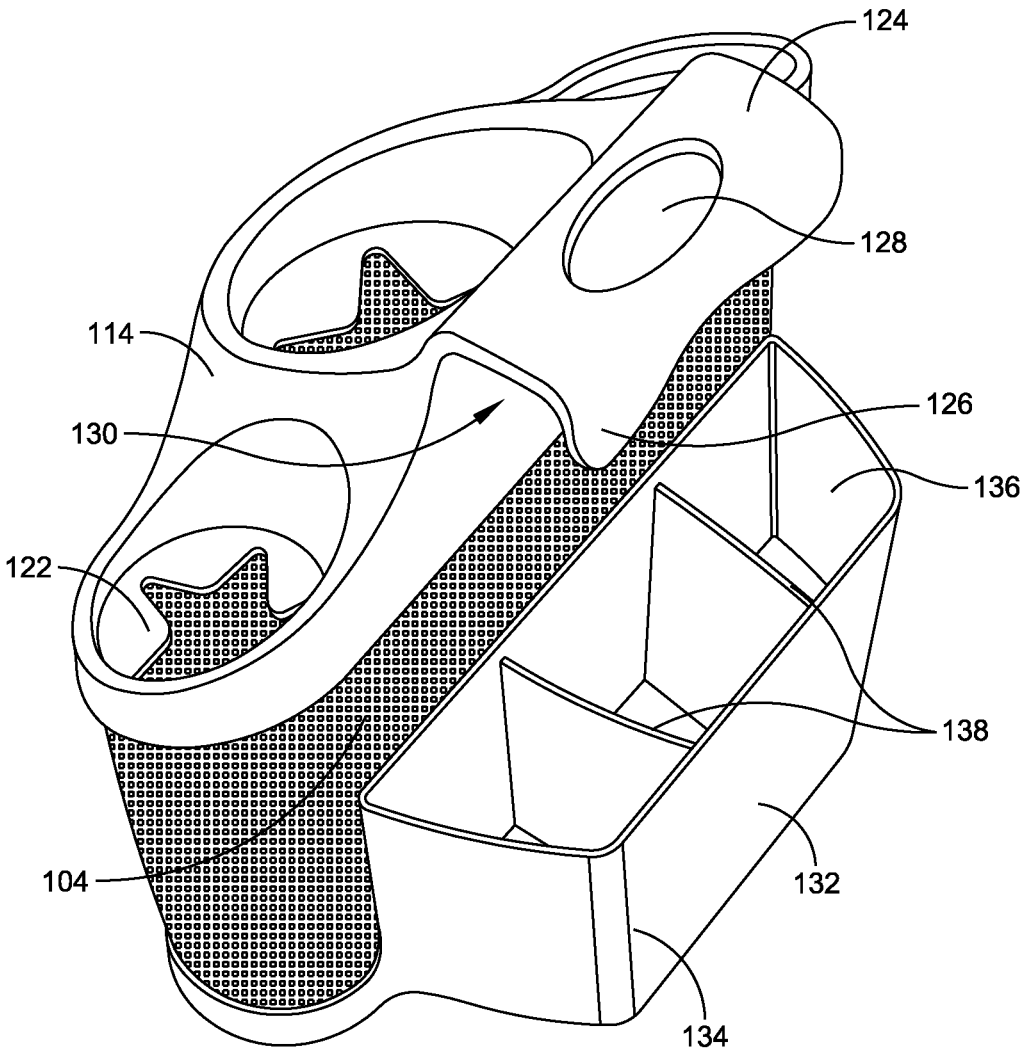
FIG. 3 is a rear isometric view of the apparatus illustrated in FIG. 1.
Figure 4:
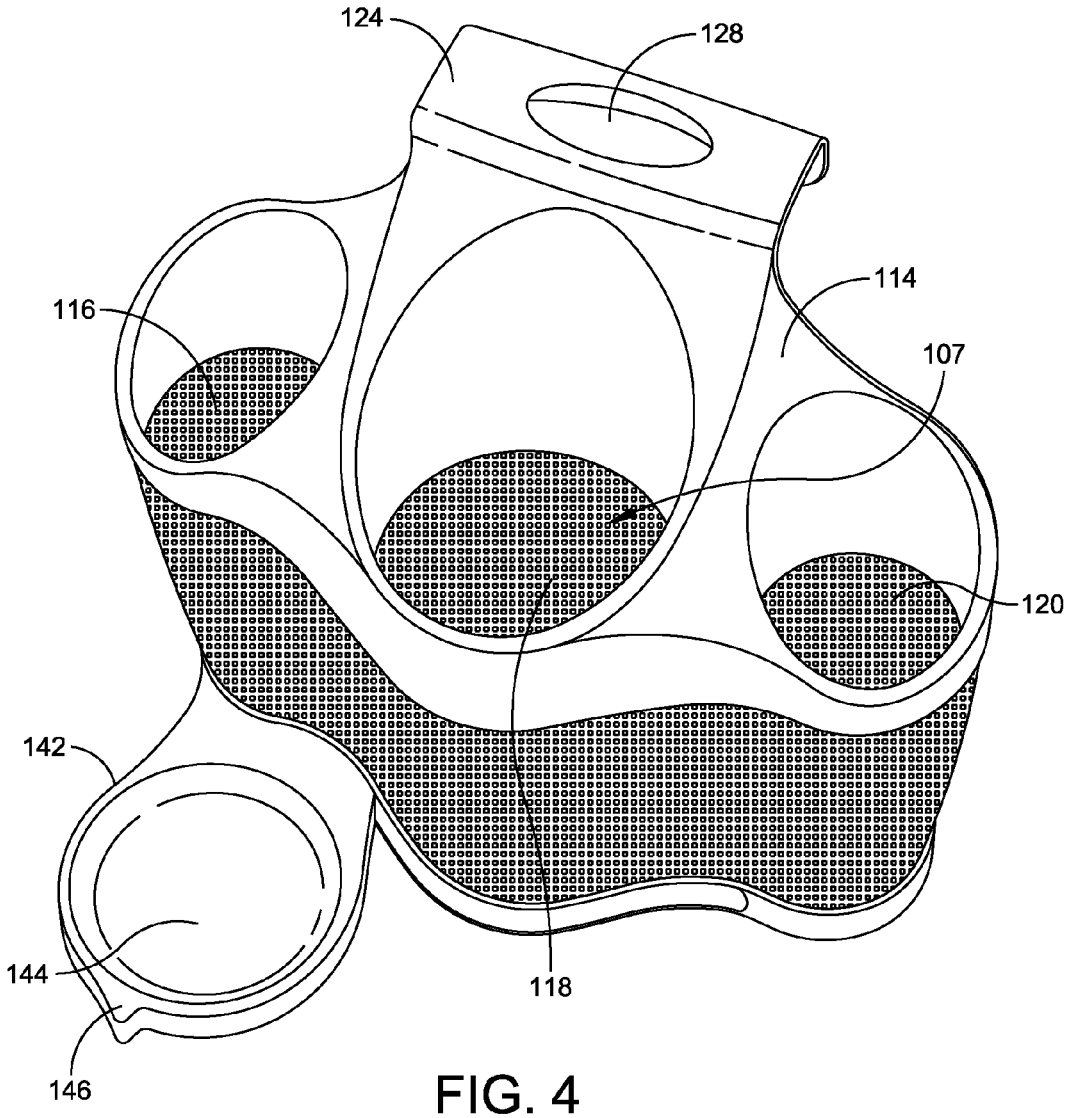
FIG. 4 is a front isometric view of the apparatus illustrated in FIG. 1 with the gaskets having been removed and configured with an optional drawer.

As best seen in FIGS. 2-4, top section 101 includes an upper surface 114 and defines a plurality of openings 116, 118, 120 that form separate compartments each sized and configured to receive a hair styling device 10 therein. For example, openings 116, 118, and 120 may be sized and configured to store a curling iron 10*a*, a blow dryer 10*b*, a hair straightener 10*c*, and other styling devices therein as illustrated in FIGS. 1 and 5-7 as well as other devices such as brushes and combs. One skilled in the art will understand that the number of openings may be greater or less than the three openings illustrated in FIGS. 2-4. Top section 101 may be fabricated from a metal or plastic material and integrally formed with or coupled to middle section 103.

In some embodiments, a gasket 122 is disposed around the upper periphery of openings 116, 118, 120 defined by upper section 101 and disposed on an upper, interior surface of bottom section 105. Gasket 122 is made from an insulating material, such as a heat-resistant material or a material having a melting point higher than a temperature at which hair styling devices 10 operate, e.g., silicone, for insulating apparatus 100 from the heated devices as best seen in FIGS. 2 and 3. Gasket 122 may be coupled to the interior of openings 116, 118, and 120 by an adhesive and be configured to releasably secure devices 10 within openings 116, 118, and 120. For example, the material of gasket 122 may be rigid enough to secure devices 10 within openings 116, 118, 120 and resilient enough to bend and enable devices 10 to be removed from openings 116, 118, 120. In some embodiments, openings 117, 118, 120 do not include a gasket 122, as shown in FIG. 4, but a gasket 122 may be disposed on an upper, internal surface of bottom section 105.

Figure 6:
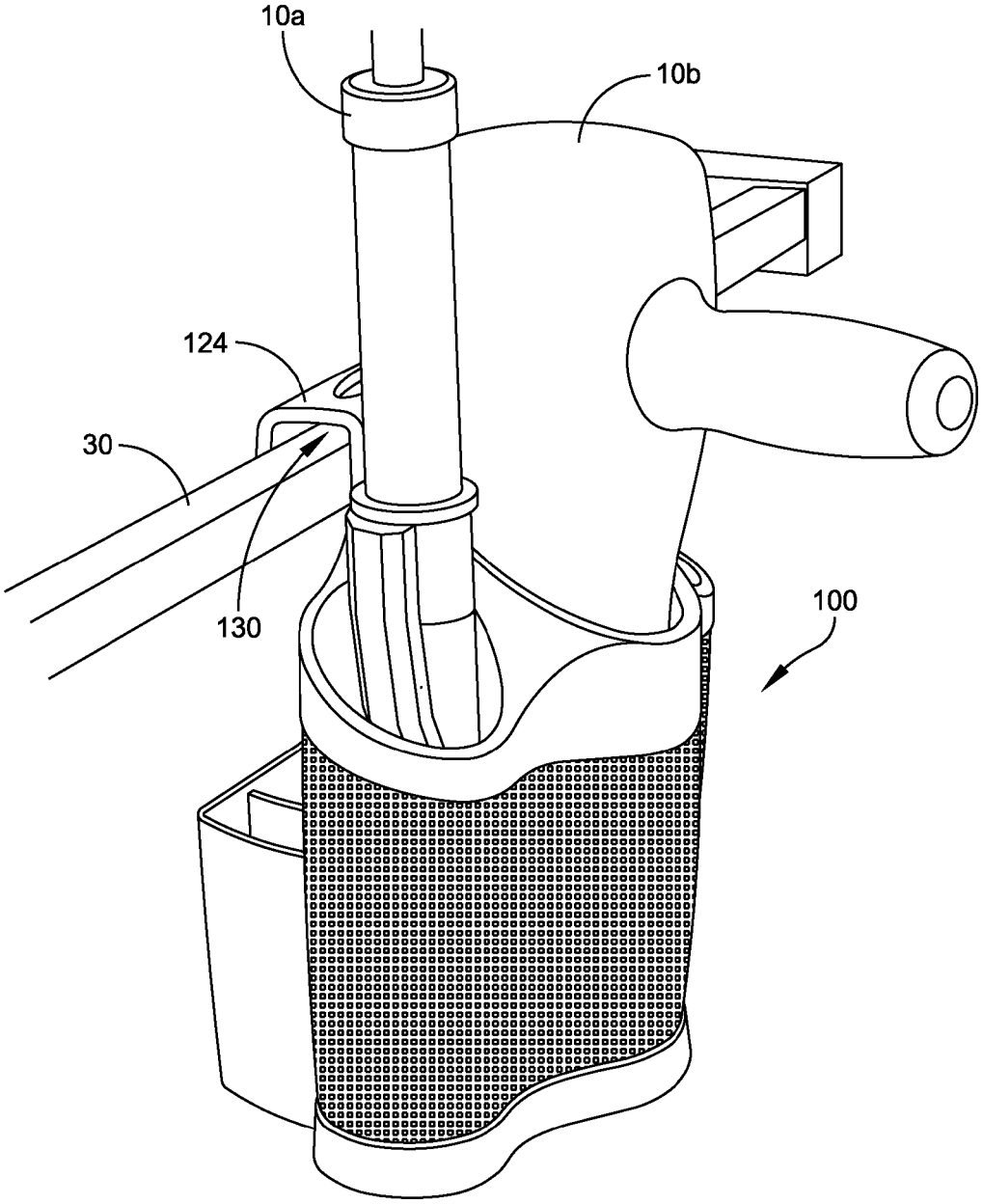
FIG. 6 illustrates an apparatus disposed on a towel rack.
Figure 7:
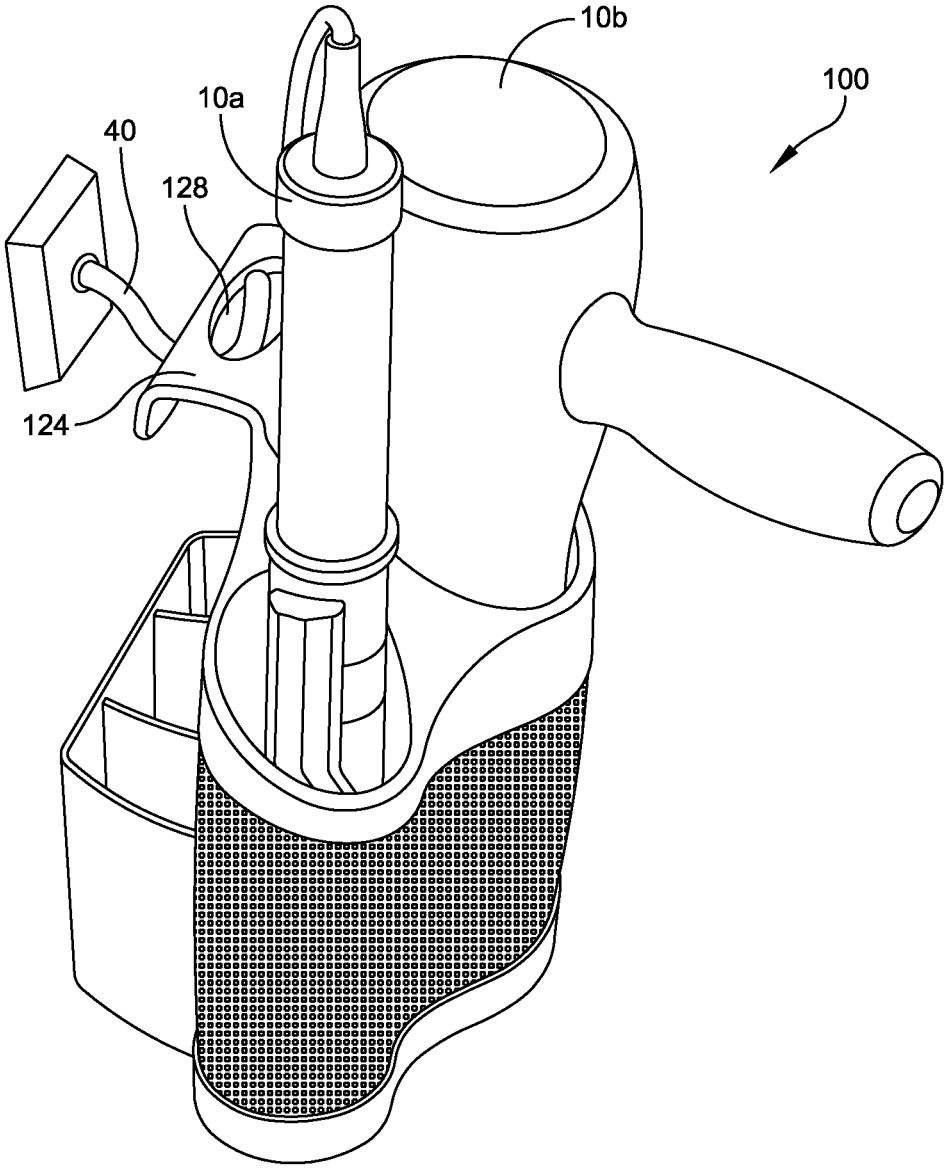
FIG. 7 illustrates an apparatus disposed on a clothes hook.

Upper section 101 includes a handle 124 that outwardly extends rear wall 104 and includes an downwardly extending extension 126. Rear wall 104, handle 124, and extension 126 together define a channel 130 sized and configured to receive an elongate rod 30, such as a towel bar or rod, such that holster apparatus 100 may be hung from a towel rack or other device as illustrated in FIG. 6. Handle 124 defines a longitudinally extending slot or a hole 128 as best seen in FIGS. 2 and 4. The slot or hole 128 has a diameter that is sized and configured to receive a clothes/coat hook 40 therein such that apparatus may be hung from a coat hook in a bathroom or other location as shown in FIG. 7. The combination of handle 124, slot or hole 128, and channel 130 advantageously enable holster apparatus 100 to be hung on a variety of objects such as on bars and hooks in addition to being disposed on a flat surface such as a counter or table top.

Hair styling device holster 100 also includes a bin 132 that is coupled to or integrally formed with rear wall 104 as best in seen in FIG. 3. Bin 132 has a plurality of walls 134 that collectively define an internal area 136 sized and configured to store the power cords of the devices stored within openings 116, 118, and 120. Internal area 136 may be divided by one or more dividing walls 138 into a plurality of separate areas such that each area may store a respective cord of each of the devices 10 stored in openings 116, 118, and 120. Walls 134, 138 of bin 132 may be formed from a plastic or polymeric material, or walls 134, 138 may be formed from a metal material.

In some embodiments and as best seen in FIGS. 1 and 4, bottom wall 112 may optionally define an opening 140 sized and configured to receive an optional drawer 142. Drawer 142 may be pivotably coupled to bottom wall 112 such that drawer 140 may rotate about an axis from a first position in which drawer 140 is contained within an opening 140 and an area defined by walls 102, 104, 106, and 108 (FIG. 1) to a second position in which at least part of drawer 142 is not contained within opening 140 and an area defined by walls 102, 104, 106, and 108 (FIG. 4). Drawer 142 defines a chamber 144 for storing small hair styling devices, such as clips, bobby pins, hair ties, etc., therein. Examples of such devices that may be stored within chamber 140 include, but are not limited to, clips, bobby pins, and hair ties, to a name a few possibilities. Drawer 142 may include a protrusion 146 extending from free end 148, i.e., the end of drawer 142 that is disposed opposite the pivotably coupled end 150, to facilitate access to drawer 142 by a user. One skilled in the art will understand that opening 140 and drawer 142 may be omitted such that bottom section 105 is solid.

Although the apparatus has been described in terms of exemplary embodiments, it is not limited thereto. Rather, the appended claims should be construed broadly, to include other variants and embodiments of the apparatus, which may be made by those skilled in the art without departing from the scope and range of equivalents of the apparatus.

What is claimed is:

1. A hair styling device holster, comprising:

a bottom section including a flat bottom surface and an interior upper surface;

a middle section coupled to the bottom section and comprising walls defining an interior compartment sized and configured to receive a heated end of a hair styling device, at least a portion of one of the plurality of walls including a mesh grating; and a top section defining a plurality of openings each in communication with the interior compartment defined by the middle section, wherein an insulating material is disposed within the plurality of openings defined by the top section and on the interior upper surface of the bottom section, and wherein the bottom section defines an opening in which a drawer is disposed.

2. The hair styling device holster of claim 1, wherein the drawer is pivotably coupled to the bottom section at one end such that the drawer is configured to pivot from a first position in which the drawer is received within the opening defined by the bottom section and a second position in which at least a portion of the drawer is disposed externally of the opening defined by the bottom section.

3. The hair styling device holster of claim 1, wherein the insulating material includes silicone.

4. The hair styling device holster of claim 1, wherein the insulating material inwardly extends into the plurality of openings defined by the top section for releasably securing hair styling devices within the openings.

5. The hair styling device holster of claim 1, wherein the top section includes an outwardly extending handle that defines a slot sized and configured to receive a hook therein.

6. The hair styling device holster of claim 5, wherein the outwardly extending handle includes an extension that defines a channel sized and configured to receive a bar therein.

7. A hair styling device holster, comprising;

a bottom section including a flat bottom surface, an interior upper surface, and an opening in which a drawer is disposed;

a middle section coupled to the bottom section and comprising walls defining an interior compartment sized and configured to receive a heated end of a hair styling device, at least a portion of one of the plurality of walls including a mesh grating;

a top section coupled to the middle section and defining at least one opening in communication with the interior compartment defined by the middle section; and a handle extending from the top section and defining a slot configured to receive a book therein for hanging the hair styling device holster, wherein an insulating material is disposed within the at least one opening defined by the top section and on the interior upper surface of the bottom section.

8. The hair styling device holster of claim 7, wherein the outwardly extending handle includes an extension that defines a channel sized and configured to receive a bar therein.

9. The hair styling device holster of claim 7, wherein the drawer is pivotably coupled to the bottom section at one end such that the drawer is configured to pivot from a first position in which the drawer is received within the opening defined by the bottom section and a second position in which at least a portion of the drawer is disposed externally of the opening defined by the bottom section.

10. The hair styling device holster of claim 7, wherein the insulating material includes silicone.

11. The hair styling device holster of claim 7, wherein the insulating material inwardly extends into the plurality of openings defined by the top section for releasably securing hair styling devices within the openings.

12. A hair styling device holster, comprising:

a bottom section including a flat bottom surface and an interior upper surface;

a middle section coupled to the bottom section and comprising walls defining an interior compartment sized and configured to receive a heated can of a hair styling device, at least a portion of one of the plurality of walls including a mesh grating; and a top section defining a plurality of openings each in communication with the interior compartment defined by the middle section, wherein an insulating material is disposed within the plurality of openings defined by the top section and on the interior upper surface of the bottom section, and wherein the insulating material inwardly extends into the plurality of openings defined by the top section for releasably securing hair styling devices within the openings.

13. The hair styling device holster of claim 12, wherein the top section includes an outwardly extending handle that defines a slot sized and configured to receive a hook therein.

14. The hair styling device holster of claim 12, wherein an outwardly extending handle includes an extension that defines a channel sized and configured to receive a bar therein.

15. The hair styling device holster of claim 12, wherein the insulating material includes silicone.

16. The hair styling device holster of claim 12, wherein the bottom section defines an opening in which a drawer is disposed.

17. The hair styling device holster of claim 16, wherein the drawer is pivotably coupled to the bottom section at one end such that the drawer is configured to pivot from a first position in which the drawer is received within the opening defined by the bottom section and a second position in which at least a portion of the drawer is disposed externally of the opening defined by the bottom section.

* * * * *

UNITED STATES PATENT AND TRADEMARK OFFICE

CERTIFICATE OF CORRECTION

PATENT NO. : 8,689,999 B2
APPLICATION NO. : 13/346461
DATED : April 8, 2014
INVENTOR(S) : Cooper et al.

It is certified that error appears in the above-identified patent and that said Letters Patent is hereby corrected as shown below:

IN THE CLAIMS:

Column 5, Claim 7, Line 1, delete ";" after "comprising" and insert -- : --

Column 5, Claim 7, Line 14, delete "book" and insert -- hook --

Column 6, Claim 12, Line 6, delete "can" and insert -- end --

Signed and Sealed this
Fourteenth Day of October, 2014

Michelle K. Lee

Michelle K. Lee
*Deputy Director of the United States Patent and Trademark Office*